US006935107B2

(12) United States Patent
Tondolo

(10) Patent No.: US 6,935,107 B2
(45) Date of Patent: Aug. 30, 2005

(54) THREE-WAY PNEUMATIC COMMUTATOR AND VOLUME BOOSTER

(75) Inventor: Flavio Tondolo, Stezzano BG (IT)

(73) Assignee: Control Components, Inc., Rancho Santa Margarita, CA (US)

( * ) Notice: Subject to any disclaimer, the term of this patent is extended or adjusted under 35 U.S.C. 154(b) by 34 days.

(21) Appl. No.: 10/724,646

(22) Filed: Dec. 1, 2003

(65) Prior Publication Data

US 2005/0115232 A1 Jun. 2, 2005

(51) Int. Cl.[7] ..... F15B 13/04
(52) U.S. Cl. ..... 60/417; 91/454
(58) Field of Search ..... 60/410, 417; 91/454, 91/455, 456, 464, 465, 466

(56) References Cited

U.S. PATENT DOCUMENTS 6,357,335 B1 * 3/2002 Lafler et al. ..... 91/459
6,732,629 B1 * 5/2004 Miller et al. ..... 91/361
6,802,242 B1 * 10/2004 Steinke et al. ..... 91/464

* cited by examiner

*Primary Examiner*—Thomas E. Lazo
(74) *Attorney, Agent, or Firm*—Stetina Brunda Garred & Brucker

(57) ABSTRACT

Disclosed is an actuator system for positioning a piston within a cylinder and comprising a compressed air source, a positioner, and first and second pneumatic valving modules. The first and second pneumatic valving modules respectively comprise first and second volume boosters to amplify the flow of compressed air, first and second derivative boosters to alternately supply and exhaust compressed air into and out of the first and second ends at high flow rates, and first and second commutators to selectively allow the compressed air to flow respectively between the volume boosters and the derivative boosters. A safety valve opens at a predetermined pressurization level such that the first and second commutators may be energized. A volume tank provides compressed air to each one of the first and second pneumatic valving modules upon energization of the first and second commutators.

20 Claims, 8 Drawing Sheets

THREE-WAY PNEUMATIC COMMUTATOR AND VOLUME BOOSTER

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention pertains generally to fluid flow control and, more particularly, to an actuator system for positioning a piston within a cylinder of a pneumatic circuit. The actuator system includes a uniquely configured pneumatic valving module for manipulating a flow of pressurized pneumatic fluid within the pneumatic circuit.

Actuator systems typically involve a source of compressed air that is routed through a network of pipes. The compressed air is typically provided by an air compressor that is usually driven by a motor. The compressed air is routed to a positioner that ultimately controls the flow of compressed air into and out of an actuator. The positioner provides a metered flow of compressed air into alternate ends of the actuator in response to a positioner input signal. The actuator may be a double acting actuator comprising a reciprocating piston sealed within a cylinder. The cylinder of a double-acting actuator has a working chamber on each end. The piston is slidably captured between the chambers. Both chambers of the actuator simultaneously receive and exhaust the compressed air as the piston moves back and forth within the cylinder. The piston may have a shaft extending out of one end of the cylinder with the shaft being connected to the component to be moved.

The actuator system moves or strokes the piston by forcing air into a first end of the cylinder while simultaneously withdrawing or exhausting air out of a second end of the cylinder in order to advance the piston along the length of the cylinder. Conversely, the actuator system may also force air into the second end of the cylinder while simultaneously exhausting air out of the first end of the cylinder in order to retract the piston in the opposite direction. By driving the air into alternate ends of the cylinder, the piston is moved such that the shaft can be displaced in any position for doing useful work. Actuator systems are commonly used in large scale applications such as in power plants and refineries for controlling system components such as a working valve. In such applications, it may be desirable to repeatedly position the piston to within thousandths of an inch within a very short stroking time. In addition, large scale applications may utilize large-volume actuators to react to the high forces that are typical of severe-service control valves.

When a large-volume actuator is utilized in the pneumatic circuit, the positioner, acting alone, may be unable to supply and exhaust a sufficient volume of compressed air to the actuator within a given time period. Such pneumatic circuits having large-volume actuators may be incapable of achieving a quick stroking speed of the piston. In such cases, a first and second derivative booster may be installed between the positioner and the respective first and second ends of the actuator, as illustrated in the prior art schematic of FIG. 1A. In such schematics, the positioner energizes the first and second derivative booster by providing pneumatic signals in the form of compressed air which is routed to the derivative boosters. The fist and second derivative boosters are shown enclosed within the dashed boxes of FIG. 1A. The derivative boosters allow the actuator system to achieve very short stroking times by increasing the flow rate of the positioner to the first end of the cylinder while simultaneously exhausting the second end of the cylinder through a large outlet, or vice versa. The flow rate of a device is typically characterized by the factor Cv, and may be mathematically expressed as the number of U.S. gallons of fluid per minute that will pass through a valve with a pressure drop of one psi at 60° F.

In an exemplary pneumatic circuit similar to that illustrated in FIG. 1A, the Cv of the positioner is typically greater than 0.6 with the corresponding Cv of the derivative boosters being 4.5 in the supply mode and 9.0 in the exhaust mode. The Cv of the derivative boosters in the exhaust mode is greater than the Cv in the supply mode because the exhaust capacity in a pneumatic circuit is typically the controlling factor in determining the stroking time of the piston. Continuing with the discussion of the operation of the prior art pneumatic circuit of FIG. 1A, the derivative boosters receive pneumatic signals at pneumatic pilots on either end of each derivative booster. Depending of the pneumatic signals at the pilots, the derivative boosters may be selectively opened and closed in order to regulate the flow of the compressed air into and out of the cylinder. The pneumatic pilots of the boosters are connected to the positioner through signal lines.

The derivative boosters are also connected to the air source through larger diameter feed lines. The signal lines are typically of a smaller diameter than the feed lines because they supply and exhaust compressed air into and out of the cylinder at relatively low flow rates. At higher flow rates, the positioner provides a greater flow of compressed air into the signal lines sufficient to trigger the pilots of the derivative boosters such that the derivative boosters are energized. When energized, the derivative boosters allow compressed air to flow from the larger diameter feed lines into and out of the cylinder at a higher flow rate, thereby reducing the stroking time of the piston. The prior art schematic illustrated in FIG. 1A which includes derivative boosters allows the actuator to achieve a relatively fast stroking time if the positioner has a flow rate that is high enough to energize the derivative boosters. However, where a low flow rate positioner is utilized, pneumatic circuits operating with large-volume actuators may not be able to energize the derivative booster. Consequently, they suffer the drawback of a slow stroking speed.

In many applications, it may be desirable to incorporate a lock up device into the pneumatic circuit wherein the piston may be set to fully extend or retract upon a loss of pressurization. Such a condition may result during a failure of the compressed air source. FIG. 1B is a schematic diagram similar to the prior art pneumatic circuit of FIG. 1A. FIG. 1B illustrates a pneumatic circuit that incorporates a lock up feature by including the additional components of a safety valve and first and second commutators. The first and second commutators are shown enclosed within dashed boxes in FIG. 1B. The first and second commutators are installed between the positioner and the respective first and second derivative boosters. The safety valve can also be seen in FIG. 1B as enclosed within a dashed box. The safety valve is installed between a filter regulator and the first and second commutators in parallel to the positioner.

Advantageously, in FIG. 1B, the safety valve and first and second commutators provide a fail safe feature wherein the actuator may be set to lock up into a fail open or fail close position upon a loss of pressurization within the pneumatic circuit. In the fail close condition, the piston is displaced toward one end of the cylinder such that the shaft of the piston is extended in order to close a working valve that may be connected to the shaft. Alternatively, in the fail open position, the piston is displaced toward the opposite end of the cylinder such that the shaft of the piston may be retracted in order to open the working valve. Although it is advantageous to incorporate a lock up feature within a pneumatic circuit, the additional components of the safety valve and the first and second commutators, as shown in FIG. 1B, unfortunately reduce the piston stroking speed.

In some applications, the flow rate of the positioner may be quite small such that the derivative boosters may not be energizable by the relatively small pneumatic signals sent by the positioner. For example, the pneumatic circuit of FIG. 1C incorporates a positioner with a Cv of less than 0.6. With such a low flow rate positioner, a pair of volume boosters may be added into the pneumatic circuit to amplify the positioner signal. In FIG. 1C, first and second volume boosters are located between the first and second commutators, respectively. The volume boosters amplify the relatively low flow rate of the positioner. In comparison to the relatively large Cv of the derivative boosters, the Cv of the volume boosters is typically only about 1.0 in the supply mode and about 1.0 in the exhaust mode. However, operating in conjunction with the volume boosters, the derivative boosters may be energized such that the flow rate into and out of the cylinder may be greatly increased. Such increased flow rate provides the actuator system with a markedly increased stroking speed of the piston. In addition, the pneumatic circuit of FIG. 1C includes the additional benefit of including the safety valve and the first and second commutators for the lock up feature.

However, the benefits that are provided by the additional first and second derivative boosters, the safety valve and the first and second commutators in FIG. 1C are accompanied by a performance penalty. In pneumatic circuits having a large number of active components, dynamic instability occurs wherein the piston is difficult to precisely and rapidly position. For example, in the pneumatic circuit of FIG. 1C, the active components include the positioner, the safety valve, the pair of derivative boosters and the pair of volume booster all connected to first and second ends of the cylinder. As a result of the maze of piping and fittings interconnecting the many active components, the total requirement of compressed air out of the positioner that is needed in order to effect a given piston movement is increased compared to pneumatic circuits having a lesser number of active components. Furthermore, due to the inherently compressible nature of air, the piston may not start to move toward the desired position until the pair of derivative boosters and the pair of volume boosters have sufficiently pressurized.

Thus, there may be an undesirable lag between the time that the positioner receives the piston position signal and the time that the piston arrives at the desired position. Also, due to the amplification chain in successively energizing the derivative and volume boosters, the piston may overshoot the final position. Overshooting occurs when the piston, moving at a relatively high rate of speed, fails to slow down as it nears the final position such that it moves past the desired position and must then reverse directions. The overshooting of the piston therefore increases the overall lag time of the actuator.

As can be seen, there exists a need in the art for an actuator system having a large-volume actuator wherein the piston has a relatively short stroking time. Also, there exists a need for an actuator system having a large-volume actuator wherein overshooting of the piston may be minimized or eliminated. In addition, there exists a need for an actuator system wherein the total requirement of compressed air out of the positioner is minimized. Furthermore, there exists a need in the art for an actuator system wherein the interactive effects of the boosters on the piston may be eliminated. Finally, there exists a need in the art for a pneumatic control system that may be retrofitted into existing pneumatic circuits.

SUMMARY OF THE INVENTION

The present invention specifically addresses and alleviates the above referenced deficiencies associated with pneumatic actuator circuits. More particularly, the present invention is an improved actuator system utilized for positioning a piston within a cylinder of a pneumatic circuit wherein the cylinder has first and second ends. The actuator system includes a compressed air source, a positioner, first and second pneumatic valving modules, a safety valve, a volume tank and an actuator. The actuator is comprised of the piston slidably sealed within the cylinder. The piston is connected to a shaft that extends out of the cylinder, the shaft being connectable to a component to be moved. The cylinder is interposed between the first pneumatic valving module and the second pneumatic valving module at respective first and second ends of the cylinder.

The simultaneous forcing of compressed air into the first end and the exhaustion of compressed air out of the second end by the combined efforts of the positioner and the pneumatic valving modules operates to advance the piston from the first end to the second end such that the shaft of the piston may be extended and retracted. The positioner regulates the flow of compressed air into and out of the first and second ends of the cylinder through the first and second pneumatic valving modules.

The first and second pneumatic valving modules are fluidly connected to the volume tank, the positioner and to each one of the first and second ends. Advantageously, the first commutator, the first volume booster and the first derivative booster are all integrated into a unitary structure of the first pneumatic valving module wherein all of the components are fluidly interconnected within a single housing. The second pneumatic valving module is comprised of the same respective components. The components of the pneumatic circuit operate together to collectively manipulate the flow of compressed air in order to regulate the position of the piston within the cylinder by use of the first and second pneumatic valving modules. In this manner, the network of pipes and fittings that are normally associated within a pneumatic circuit are eliminated. By reducing the amount of piping within the pneumatic circuit, the overall performance of the actuator system, specifically the stroking time and responsiveness of the actuator, may be improved.

The safety valve and first and second commutators may be toggled between a fail safe mode and a control mode. In the control mode, the safety valve receives the compressed air from the air source and directs it to the first and second commutators which then toggle into the supply position, allowing compressed air to flow between the respective first and second volume boosters and respective first and second derivative boosters. The volume tank is configured to provide compressed air to each one of the first and second pneumatic valving modules upon energization of the first and second commutators.

The first and second volume boosters are configured to amplify the pneumatic signals of the positioner. Whereas the positioner alone may be insufficient to trigger the first and second derivative boosters, the amplification of the positioner signal by the first and second volume boosters will energize the first and second derivative boosters and allow a higher supply and exhaustion of compressed air into and out of the actuator. The commutators are fluidly connected between the derivative boosters and the volume boosters and are configured to selectively allow the compressed air to flow therebetween.

The integration of the volume boosters, commutators and derivative boosters into pneumatic valving modules advantageously reduces the length of connective piping and fittings included in conventional pneumatic circuits. Such a configuration of the pneumatic valving modules effectively reduces the total requirement of compressed air out of the positioner for a given piston movement. The compact configuration of the first and second pneumatic valving modules helps to eliminate the interactive effects of the individual boosters on the piston, thereby controlling overshooting of the piston.

BRIEF DESCRIPTION OF THE DRAWINGS

These as well as other features of the present invention will become more apparent upon reference to the drawings wherein:

FIG. 1B is a prior art schematic diagram similar to the pneumatic circuit of. FIG. 1A illustrating the connective relationship between additional components of a safety valve and first and second commutators;

Figure 1A:
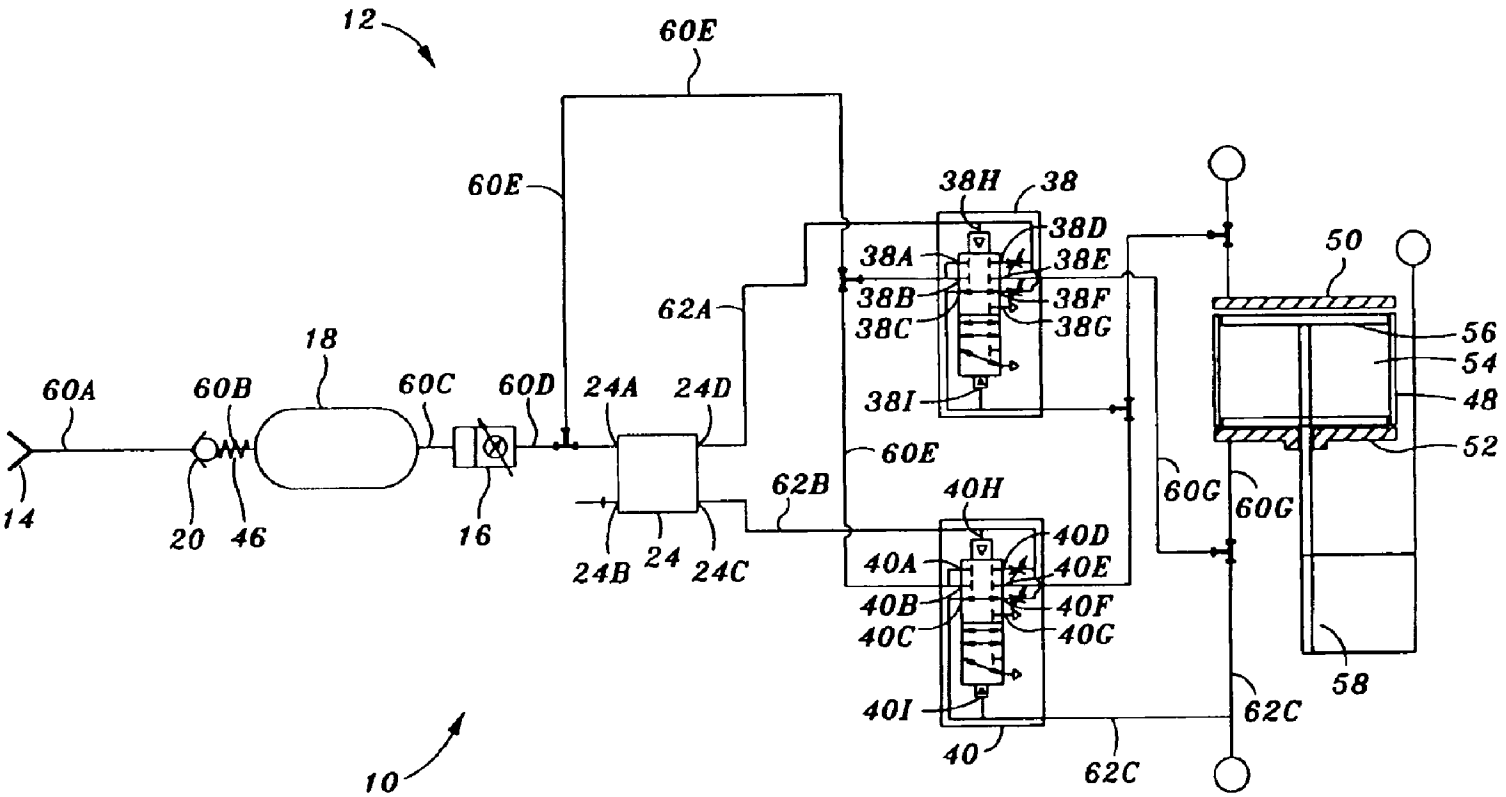
Fig. 1A (PRIOR ART)
FIG. 1A is a prior art schematic diagram of a pneumatic circuit of the prior art illustrating the connective relationship of first and second derivative boosters interposed between a positioner and an actuator.
Figure 1B:
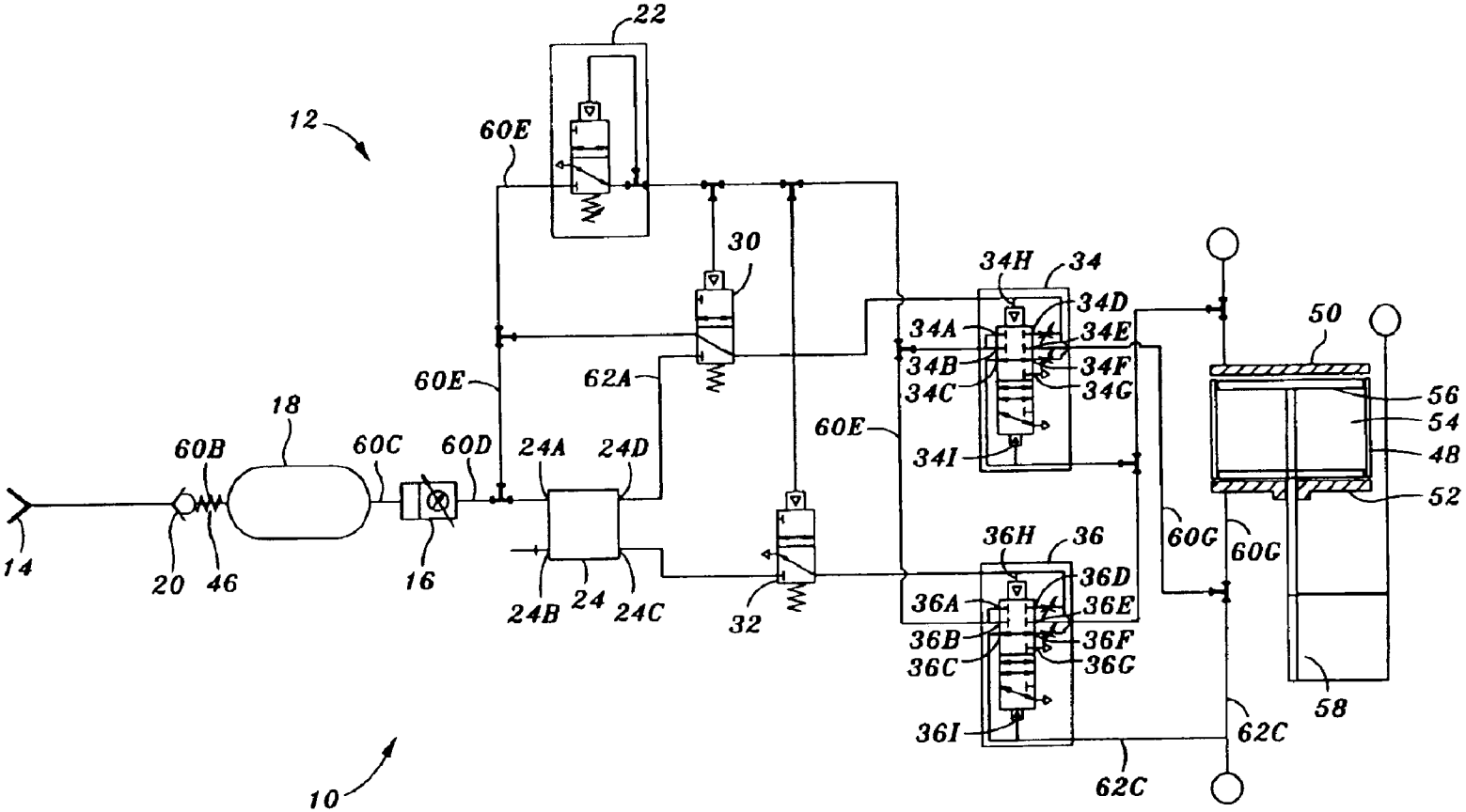
Fig. 1B (PRIOR ART)
Figure 1C:
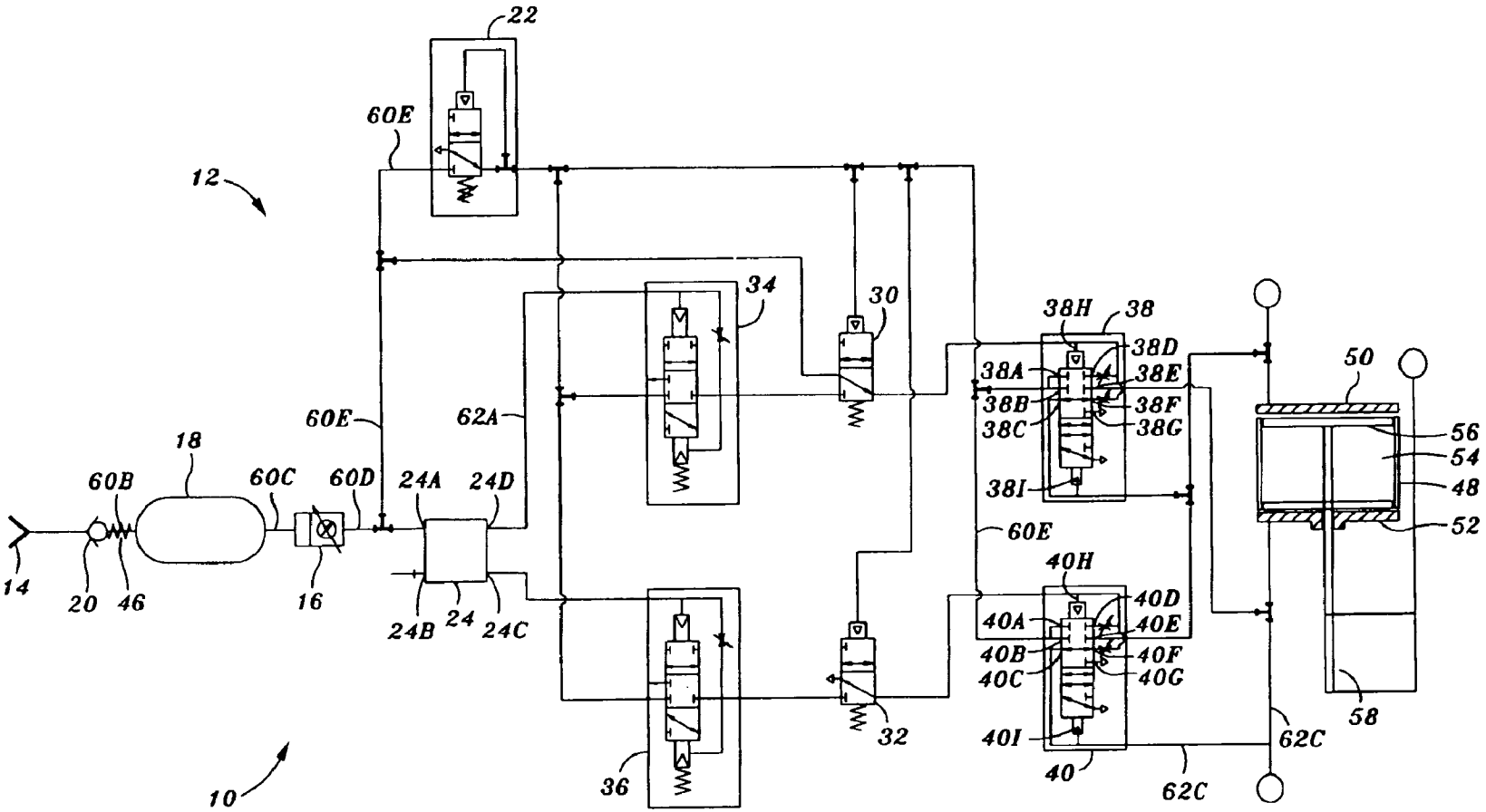
Fig. 1C (PRIOR ART)
FIG. 1C is a schematic diagram similar to the pneumatic circuit of FIG. 1B illustrating the connective relationship between additional components of a first and second volume booster interposed between the positioner and respective ones of the first and second commutators.

The drawing employs conventional graphic symbols for fluid power diagrams as specified in American National Standards Institute Y32.10.

DETAILED DESCRIPTION OF THE INVENTION

Figure 2:
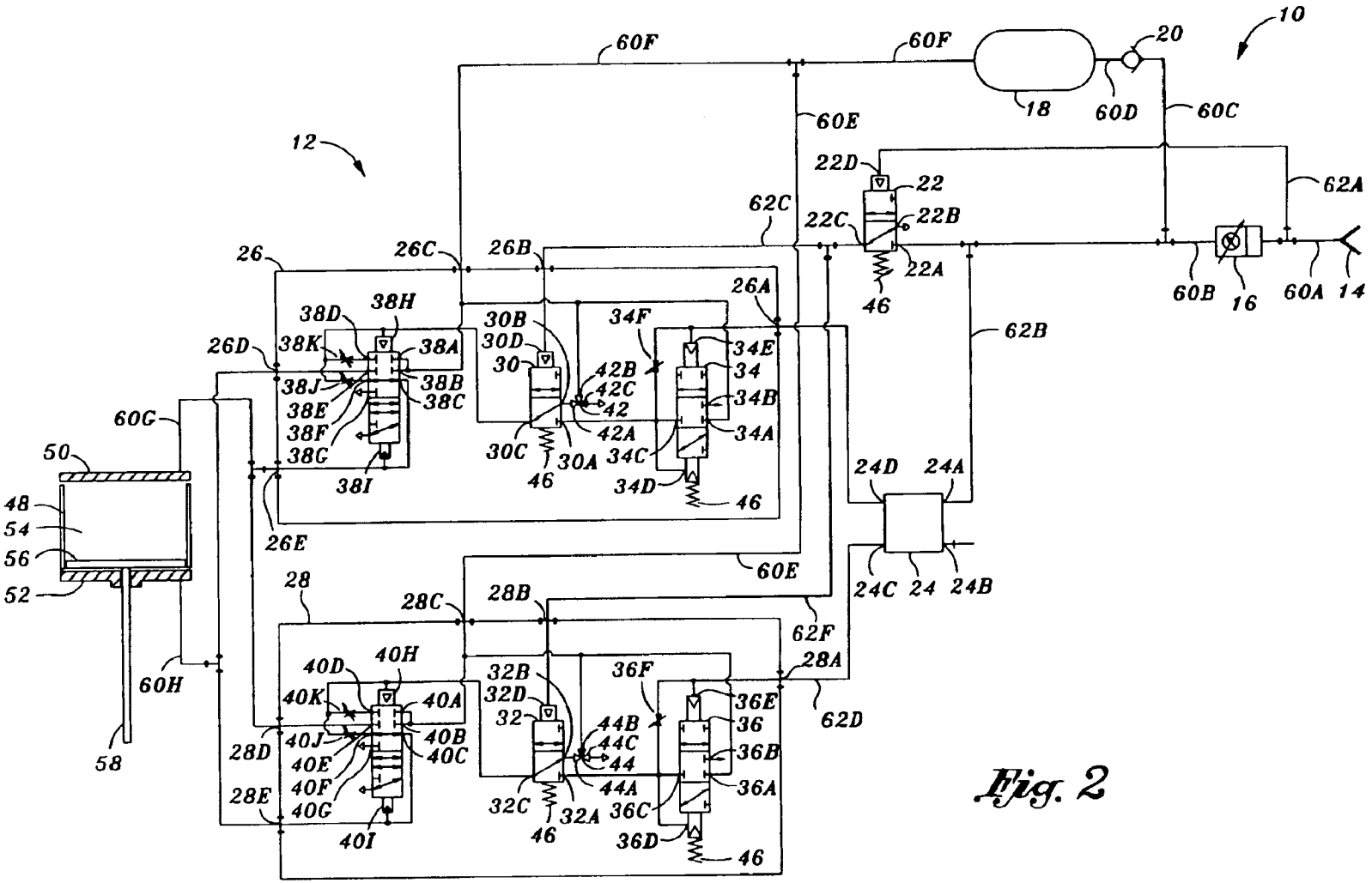
FIG. 2 is a schematic diagram of a first embodiment of the present invention illustrating the connective relationship of a first and second pneumatic valving module interposed between an actuator and a positioner, the first and second valving modules respectively incorporating first and second derivative boosters, first and second commutators, and first and second volume boosters therewithin.

Referring now to the drawings wherein the showings are for purposes of illustrating the present invention and not for purposes of limiting the same, FIG. 2 illustrates a schematic diagram of an actuator system 10 in a first embodiment of the present invention. The actuator system 10 may be utilized for positioning a piston 56 within a cylinder 54 of a pneumatic circuit 12 wherein the cylinder 54 has first and second ends 50, 52. The actuator system 10 of the first embodiment includes a compressed air source 14, a positioner 24, first and second pneumatic valving modules 26, 28, a safety valve 22, a volume tank 18 and an actuator 48. The actuator 48 is comprised of the piston 56 slidably sealed within the cylinder 54. The piston 56 is connected to a shaft 58 that extends out of the cylinder 54, the shaft 58 being connectable to a component to be moved. Cylinder 54 is shown in FIG. 2 as interposed between and in fluid communication via feed lines 60G, 60H with the first pneumatic valving module 26 and the second pneumatic valving module 28 at respective first and second ends 50, 52 of the cylinder 54.

The simultaneous forcing of compressed air into the first end 50 and the exhaustion of compressed air out of the second end 52 by the combined efforts of the positioner 24 and the first and second pneumatic valving modules 26, 28 operates to advance the piston 56 from the first end 50 to the second end 52 such that the shaft 58 of the piston 56 may be extended. Conversely, the simultaneous forcing of compressed air into the second end 52 and the exhaustion of compressed air out of the first end 50 operates to advance the piston 56 from the second end 52 to the first end 50 such that the shaft 58 of the piston 56 may be retracted. The compressed air source 14 provides a flow of compressed air to the pneumatic circuit 12. Compressed air may be provided by a compressor that is usually driven by an electric motor or an internal combustion engine. Optionally, a filter regulator 16 may be included in the pneumatic circuit 12, as can be seen in FIG. 2.

The source 14 of compressed air may be provided at a much higher pressurization level than can be utilized by the pneumatic circuit 12. For example, the compressed air may be pressurized at up to 1000 psi. Because standard pneumatic circuits 12 are designed to operate at a lower level of pressurization, the filter regulator 16 reduces the pressurization level of the source 14 of air to a safe working level. The filter regulator 16 of the pneumatic circuit 12 of the present invention may be preset to a maximum of 150 psi. The filter regulator 16 also filters the source 14 of compressed air to remove contaminates, oil and water-vapor that may harm downstream components. The filter regulator 16 is fluidly connected with the compressed air source 14 through a feed line 60A.

Also shown in FIG. 2 is the positioner 24 incorporated into the pneumatic circuit 12 of the present invention. The positioner 24 includes a supply port 24A, a signal port 24B and control ports 24C, 24D. The positioner 24 is in fluid communication with the filter regulator 16 through a signal line 62B at the supply port 24A. The positioner 24 supplies and receives compressed air from the first and second ends 50, 52 through the control ports 24C, 24D. Control port 24D fluidly connects the positioner 24 to the first pneumatic valving module 26 through volume booster port 26A via signal line 62C. Control port 24C fluidly connects the positioner 24 to the second pneumatic valving module 28 through volume booster port 28A via signal line 62D. As will be explained in more detail below, the positioner 24 regulates the flow of compressed air into and out of the first and second ends 50, 52 of the cylinder 54 through the first and second pneumatic valving modules 26, 28. A piston position indicator (not shown) may be mounted adjacent the cylinder 54 for sensing an actual position of the piston 56 within the cylinder 54 and generating a piston 56 position signal in response thereto.

The piston 56 position signal may be supplied to the positioner 24 at the signal port 24B through a pneumatic control line (not shown) connected to the cylinder 54. In this regard, the positioner 24 may utilize 3–15 psi pneumatic control signals supplied from a distributed microelectronic control system (DCS). It is also contemplated that the piston 56 position signal may be electronically transmitted to the positioner 24 via an electrical line. The piston position indicator may be comprised of pickup magnets mounted on the piston 56. A feedback transducer may be mounted on the cylinder 54 and may be electrically connected to the positioner 24. The positioner 24 may be fitted with current-to-pressure transducers for 4–20 mA signal inputs supplied from an electronic controller.

Feedback on the position of the piston 56 within the cylinder 54 may also be provided to the positioner 24 by a feedback arm mechanically connected to the piston 56. The positioner 24 may convert the piston 56 position signal to a pneumatic signal representative of a desired position of the piston 56. In response to the pneumatic signal, the flow of compressed air may be alternately directed into the first and second ends 50, 52 for respectively retracting and extending the piston 56 to correct for disparity between the actual position of the piston 56 and the desired position thereof.

Figure 5:
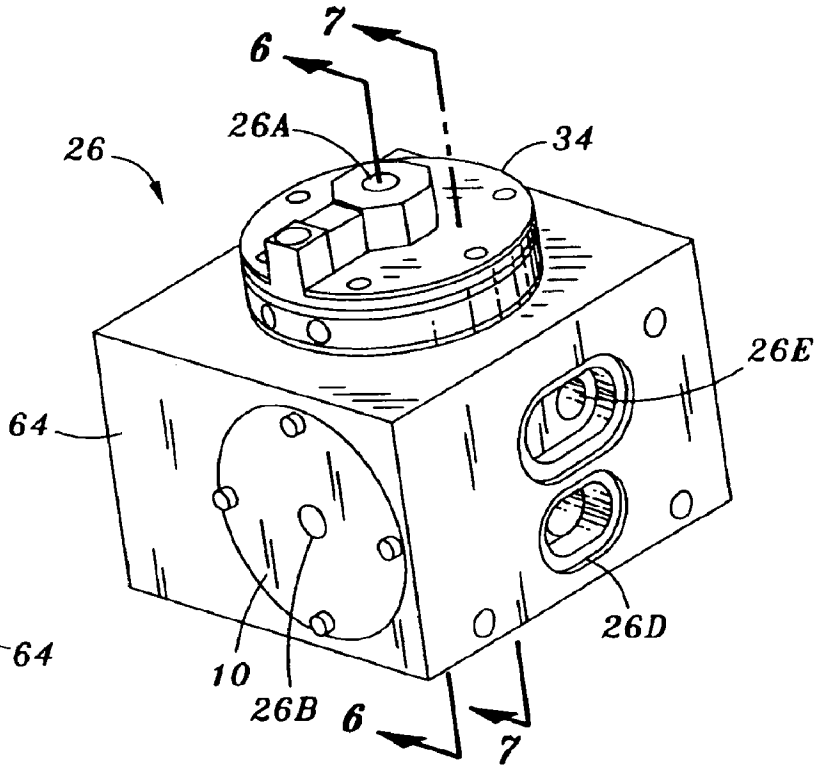
FIG. 5 is a perspective view of the pneumatic valving module illustrating the incorporation of the commutator, the volume booster and the derivative booster into a housing of the pneumatic valving module.
Figure 6:
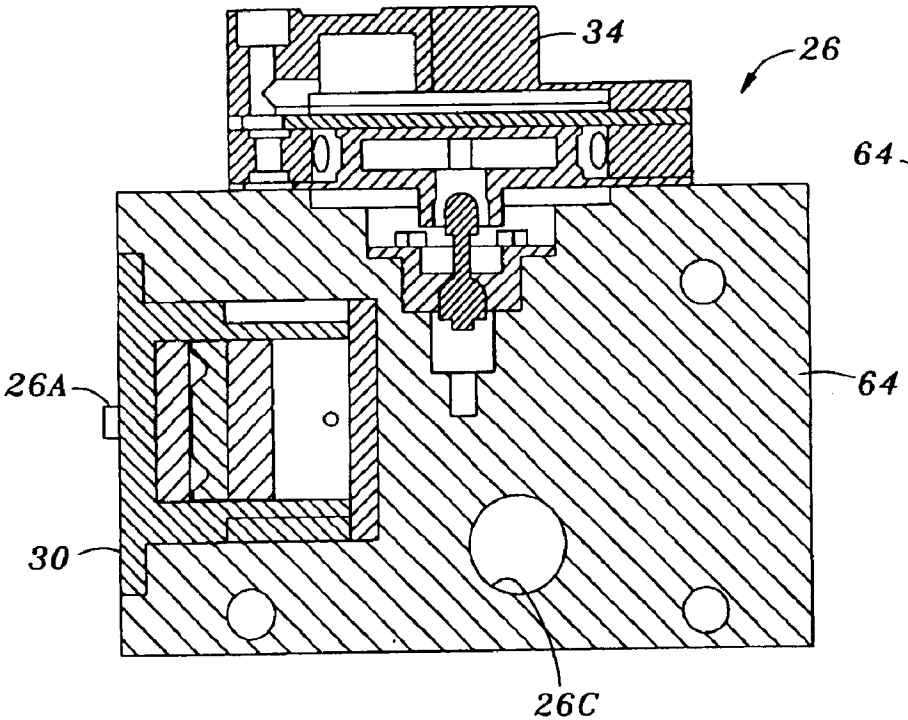
FIG. 6 is a side elevational view taken along line 6—6 of the pneumatic valving module of FIG. 5 illustrating the structural arrangement of the volume booster and the derivative booster disposed within the housing.
Figure 7:
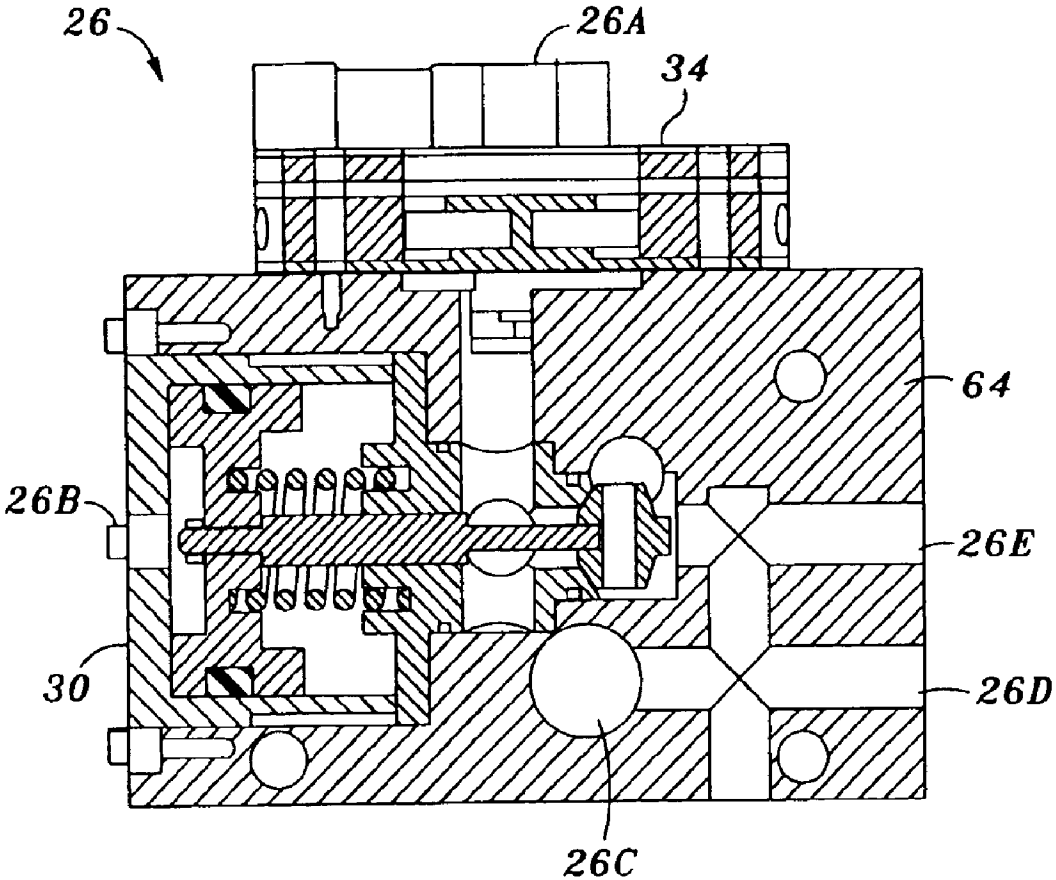
FIG. 7 is a side elevational view taken along line 7—7 of the pneumatic valving module of FIG. 5 illustrating a commutator inlet port and pneumatic valving module air supply port.

The first and second pneumatic valving modules 26, 28 are fluidly connected to the volume tank 18, the positioner 24 and to each one of the first and second ends 50, 52. FIGS. 5, 6 and 7 illustrate the first pneumatic valving module 26 and the incorporation of the first commutator 30, the first volume booster 34 and the first derivative booster 38 therewithin. Advantageously, the first commutator 30, the first volume booster 34 and the first derivative booster 38 are integrated into a unitary structure wherein each of the components are disposed adjacent each other in a housing 64, as shown in 5. In this regard, the network of pipes and fittings that are normally included within the pneumatic circuit 12 are eliminated.

By reducing the amount of piping within the pneumatic circuit 12, the overall performance of the actuator system 10, and specifically the stroking time and responsiveness of the actuator 48, may be improved as compared to conventional pneumatic circuits. These advantages will be demonstrated below. The second pneumatic valving module 28 is identical in arrangement and operation to the first pneumatic valving module 26 shown in FIGS. 5, 6 and 7. The first pneumatic valving module 26 includes and is fluidly interconnected to the pneumatic circuit 12 through the volume booster port 26A, a commutator port 26B, an air supply port 26C, a first derivative booster port 26D and a second derivative booster port 26E. Likewise, the second pneumatic valving module 28 includes and is fluidly interconnected to the pneumatic circuit 12 through a volume booster port 28A, a commutator port 28B, an air supply port 28C, a first derivative booster port 28D and a second derivative booster port 28E.

As can be seen in FIG. 5, the volume booster port 26A is exposed on one side of the housing 64 such that it may be easily connectable to the positioner 24. The commutator port 26B may also be seen in FIGS. 5, 6 and 7, and is also exposed on the side of the housing 64 such that it may be readily connectable to the safety valve 22. The air supply port 26C may be seen in FIGS. 6 and 7 passing through the housing 64 to the side thereof where it may be connectable to the volume tank 18. The first and second derivative booster ports 26D, 26E may be seen in FIGS. 5 and 7 as being disposed on a side of the housing 64 where they may be connectable to the actuator 48. Thus, the first pneumatic valving module 26 may be easily attached directly to the actuator 48 with the supply of compressed air entering through only one large diameter port, aside from the smaller diameter signal lines for the first volume booster 34 and first commutator 30. The arrangement of the second pneumatic valving module 28 is identical to that of the first pneumatic valving module 26 except for the substitution of the second derivative booster 40, second commutator 32 and second volume booster 36.

The safety valve 22 is fluidly connected to the compressed air source 14 and each one of the first and second commutators 30, 32. The safety valve 22 includes ways 22A, 22B and 22C and pilot 22D. The safety valve 22 may be toggled between a fail safe mode and a control mode. In the control mode, the components of the pneumatic circuit 12 work together to collectively manipulate the flow of compressed air in order to regulate the position of the piston 56 within the cylinder 54. The safety valve 22 is configured to open upon attainment of a predetermined pressurization level of the compressed air at the pilot 22D such that compressed air may flow from the air source 14 to the first and second commutators 30, 32 through the first and second commutator ports 26B, 28B of the respective first and second pneumatic valving modules 26, 28. In this manner, the first and second commutators 30, 32 may be energized, and the actuator system 10 is then placed into the control mode. The safety valve 22 is schematically illustrated in FIG. 2 as being fluidly connected to the compressed air source 14 through the feed line 60B. The safety valve 22 is fluidly connected to the first commutator 30 through signal line 62E. The safety valve 22 is also fluidly connected to the second commutator 32 through signal line 62F.

The safety valve 22 is a two-position, three-way, pneumatically controlled, spring centered valve. A spring 46 biases the safety valve 22 to a normally "closed" or fail safe position. Although shown in FIG. 2 as having a mechanical biasing spring 46, it is contemplated that other biasing means may be utilized with the safety valve 22 for biasing into the normally closed position. For example, the safety valve 22 may be actuated by an electrical solenoid in response to an electrical signal indicating a loss of pneumatic pressure in the pneumatic circuit 12. The safety valve 22 pilot 22D is connected to the air source 14 by signal line 62A.

When pressure in the signal line 62A overcomes the force of the spring 46, the safety valve 22 opens such that compressed air may pass through ways 22B–22C and be delivered to the first and second commutators 30, 32 through signal lines 62E, 62F. The safety valve 22 enables the flow of compressed air to pass between the compressed air source 14, and the first and second commutators 30, 32. The safety valve 22 may be set to open when the pressurization level of the compressed air reaches 50 psi. Conversely, the safety valve 22 may be set to close when the pressurization level of the compressed air drops below 50 psi, as a fail safe mechanism.

In the closed position, the compressed air within the actuator system 10 may exhaust through the safety valve 22 through ways 22C–22B. The exhausting compressed air then allows the first and second commutators 30, 32 to then toggle into the closed position, blocking the flow of compressed air between the first and second derivative boosters 38, 40 and the respective first and second volume boosters 34, 36. In the open position, the safety valve 22 receives the compressed air from the air source 14 and directs it to the first and second commutators 30, 32. The first and second commutators 30, 32 toggle into the supply position, allowing compressed air to flow between the respective first and second volume boosters 34, 36 and respective first and second derivative boosters 38, 40, as will be explained in more detail below.

The volume tank 18 is fluidly connected to the compressed air source 14 via feed lines 60C and 60D. The volume tank 18 is configured to provide compressed air to each one of the first and second pneumatic valving modules 26, 28 upon energization of the first and second commutators 30, 32. The volume tank 18 is also fluidly connected to the first derivative booster 38 through feed line 60F and is fluidly connected to the second derivative booster 40 through feed line 60E. Because the filter regulator 16 can only supply compressed air at a limited flow rate, the volume tank 18 provides compressed air during periods of high flow rate demand within the pneumatic circuit 12.

As can be seen in FIG. 2, a volume tank check valve 20 may optionally be included in the pneumatic circuit 12. The volume tank check valve 20 is fluidly connected to and interposed between the volume tank 18 and the compressed air source 14. Feed line 60C fluidly connects the air source 14 to the volume tank check valve 20 while feed line 60D connects the volume tank check valve 20 to the volume tank 18. The volume tank check valve 20 may be oriented to block the flow of compressed air from the volume tank 18 to the air source 14, while allowing flow in the opposite direction. The volume tank 18 may be filled with compressed air and held at the pressure set by the filter regulator 16.

As was mentioned above, the actuator system 10 includes the first and second pneumatic valving modules 26, 28. The first and second pneumatic valving modules 26, 28 are uniquely configured for manipulating the flow of compressed air within the pneumatic circuit 12 by combining the first and second volume boosters 34, 36, first and second derivative boosters 38, 40, and first and second commutators 30, 32. The first and second volume boosters 34, 36 are fluidly connected to the positioner 24 and are configured to amplify the flow of compressed air through respective ones of the first and second pneumatic valving modules 26, 28. In the schematic of FIG. 2, the first and second volume boosters 34, 36 are three-position, three-way, pneumatically controlled, spring centered valves. A spring 46 biases the volume boosters to a null or normally closed position, as shown in FIG. 2. The two alternate positions of the volume boosters 34, 36 are provided to alternately allow the compressed air to flow toward and away from the positioner 24. Although shown having a mechanical biasing spring 46, other biasing means may be utilized for biasing in the normally closed position. The first and second volume boosters 34, 36 respectively include ways 34A, 34B, 34C, 36A, 36B, 36C and pneumatic pilots 34D, 34E, 36D, 36E. Respective ones of the pilots 34D, 34E, 36D, 36E are connected to the positioner 24 via internal passages (not shown) within the housing 64.

The first and second volume boosters 34, 36 each include a first adjustable restriction 34F, 36G fluidly connected to the respective pilots 34E, 36E of the first and second volume boosters 34, 36, as can be seen in FIG. 2. The first adjustable restrictions 34F, 36G are configured to regulate the point at which the first and second volume boosters 34, 36 are activated such that the signals of the positioner 24 may be amplified. Whereas the positioner 24 alone may be insufficient to trigger the first and second derivative boosters 38, 40, the amplification of the positioner 24 signal by the first and second volume boosters 34, 36 will trigger the first and second derivative boosters 38, 40 and allow for a higher supply and exhausting flow of compressed air to pass therethrough, as will be explained in more detail below.

The first and second derivative boosters 38, 40 are fluidly connected to each one of the first and second ends 50, 52 and are configured to alternately supply and exhaust compressed air into and out of the first and second ends 50, 52. In the schematic of FIG. 2, the first and second derivative boosters 38, 40 are two-position, seven-way, pneumatically controlled valves. The first and second derivative boosters 38, 40 respectively include ways 38A, 38B, 38C, 38D, 38E, 38F, 38G, 40A, 40B, 40C, 40D, 40E, 40F, 40G and respective pneumatic pilots 38H, 38I, 40H, 40I. Shown in FIG. 2 in a normally closed position, the alternate positions of the derivative boosters 38, 40 are provided to allow the compressed air to flow in opposite directions therethrough in order to allow rapid exhausting at a high flow rate with an additional supply of compressed air from the volume tank 18 flowing through the derivative booster into the opposite end of the cylinder 54 from that which is being simultaneously exhausted. Each pilot 34E, 36E is connected to the positioner 24 via internal passages schematically visible in FIG. 2 although not visible in FIGS. 6 and 7.

The first and second commutators 30, 32 are fluidly connected between respective ones of the first and second derivative boosters 38, 40 and respective ones of the first and second volume boosters 34, 36 and are configured to selectively allow the compressed air to flow respectively therebetween. Like the safety valve 22, each one of the first and second commutators 30, 32 is a two-position, three-way, pneumatically controlled, spring centered valve. A spring 46 biases the safety valve 22 to a normally "closed" position although other biasing means may be utilized similar to those described above for the safety valve 22. The first commutator 30 includes a pilot 30D connected to the safety valve 22 by signal line 62E. The second commutator 32 includes a pilot 32D connected to the safety valve 22 by signal line 60E. The first commutator 30 includes ways 30A, 30B, 30C while the second commutator 32 includes ways 32A, 32B, 32C.

The integration of the respective first and second volume boosters 34, 36, respective first and second commutators 30, 32, and respective first and second derivative boosters 38, 40 into the respective first and second pneumatic valving modules 26, 28 advantageously reduces the length of connective piping and fittings included in conventional pneumatic circuits. Such a configuration of the first and second pneumatic valving modules 26, 28 effectively reduces the total requirement of compressed air out of the positioner 24 for a given piston 56 movement. The compact configuration of the first and second pneumatic valving modules 26, 28 helps to eliminate the interactive effects of the individual boosters 34, 36, 38, 40 on the piston 56.

Referring to FIG. 2, the actuator system 10 may further comprise first and second internal plugs 42, 44. The first internal plug 42 includes ways 42A, 42B, 42C. The second internal plug 44 includes ways 44A, 44B, 44C. The first internal plug 42 is fluidly connected between the first commutator 30 and the volume tank 18. The second internal plug 44 is fluidly connected between the second commutator 32 and the volume tank 18. The first and second internal plugs 42, 44 are selectively operative to exhaust compressed air out of the cylinder 54 through alternate ones of the first and second commutators 30, 32 such that the piston 56 may be alternately and respectively extended and retracted upon a loss of pressurization of the pneumatic circuit 12.

In the pneumatic circuit 12 of the first embodiment of FIG. 2, the second internal plug 44 is arranged such that the compressed air may exhaust the second end 52 through the second commutator 32 through ways 32A–32C upon a loss of pressurization within the pneumatic circuit 12. Simultaneously, first internal plug 42 is arranged such that the residual compressed air from the volume tank 18 may be directed into the first end 50 through the first commutator 30 through ways 30A–30B. When the first and second internal plugs 42, 44 are arranged in such a manner, the piston 56 may be extended into a fail close position upon a loss of pressurization.

Conversely, the first internal plug 42 may arranged such that the compressed air may exhaust from the first end 50 through the first commutator 30 through ways 30A–30C upon a loss of pressurization within the pneumatic circuit 12 while the second internal plug 44 is arranged such that the residual compressed air from the volume tank 18 may be directed into the second end 52 through the second commutator 32 through ways 32A–32B. When the first and second internal plugs 42, 44 are arranged in this alternate configuration, the piston 56 may be retracted into a fail open position upon a loss of pressurization. Thus, the arrangement of the first and second internal plugs 42, 44 offers flexibility in the manner in which the actuator 48 is set to fail close or fail open. Simply by switching the ways 30A, 30B, 30C, 32A, 32B, 32C, the lock up position of the actuator 48 may be easily changed within the same pneumatic circuit 12.

In the actuator system 10 of the first embodiment illustrated in FIG. 2, the first and second derivative boosters 38, 40 may each include a first adjustable restriction 38J, 40J. The first adjustable restriction 38J of the first derivative booster 38 is fluidly connected to the first commutator 30. The first adjustable restriction 40J of the second derivative booster 40 is fluidly connected to the second commutator 32. As will be explained in more detail below, each one of the first adjustable restrictions 38J, 40J may be configured to regulate the point at which the first and second derivative boosters 38, 40 are energized such that, for example, compressed air from the volume tank 18 may flow into the second end 52 of the cylinder 54 while compressed air is rapidly exhausted out of the first end 50, thereby increasing the stroking speed of the piston 56.

As can be seen in FIG. 2, the first and second derivative boosters 38, 40 may also each include a second adjustable restriction 38K, 40K configured to provide a back flow from the volume tank 18 when the first and second derivative boosters 38, 40 are in the energized position. In the pneumatic circuit 12 of FIG. 2, the second adjustable restriction 38K of the first derivative booster 38 is fluidly connected to the first commutator 30. The second adjustable restriction 40K of the second derivative booster 40 is fluidly connected to the second commutator 32. As in the arrangement of the first adjustable restrictions 38J, 40J, each one of the second adjustable restrictions 38K, 40K may be configured to regulate the point at which the respective ones of the first and second volume boosters 34, 36 are de-energized such that compressed air from the volume tank 18 may flow into the cylinder 54.

For example, in the condition wherein the compressed air is exhausting out of the first end 50 at relatively low flow rates, the compressed air will pass through the first derivative booster 38, through the first adjustable restriction 38J, through the first commutator 30 and out to the positioner 24 through the first volume booster 34. However, at higher flow rates, depending on the setting of the first adjustable restriction 38J, the pressure differential across the first adjustable restriction 38J causes the first derivative booster 38 to toggle into the exhaust mode wherein the compressed air exhausts through way 38C–38G. Simultaneously, ways 38B-38E of the first derivative booster 38 are connected allowing compressed air to flow from the volume tank 18 such that compressed air will flow into the second end 52. This causes the stroking speed of the piston 56 to increase. At the same time, a back flow from the volume tank 18 passes through the second adjustable restriction 38K, depending on the setting thereof.

When the positioner 24 is operating at high flow rates, the back flow of compressed air passes through the first commutator 30, through the first volume booster 34 and to the positioner 24 in a manner similar to that described above. However, when the positioner 24 is operating at low flow rates, the pressure differential across the second adjustable restriction 38K causes the first derivative booster 38 to de-energize such that the back flow to the positioner 24 is blocked and the flow from the volume tank 18 into the second end 52 is also blocked. This blockage slows the piston 56 as it nears the end of its movement, minimizing the risk that the piston 56 will overshoot the desired piston 56 position. Thus, the adjustment of the second adjustable restriction 38K determines the amount of flow that is needed to deactivate the first derivative booster 38. The operation of the second derivative booster 40 and related components is the same as that described above for the first derivative booster 38 wherein movement of the piston 56 is in the opposite direction.

Figure 3:
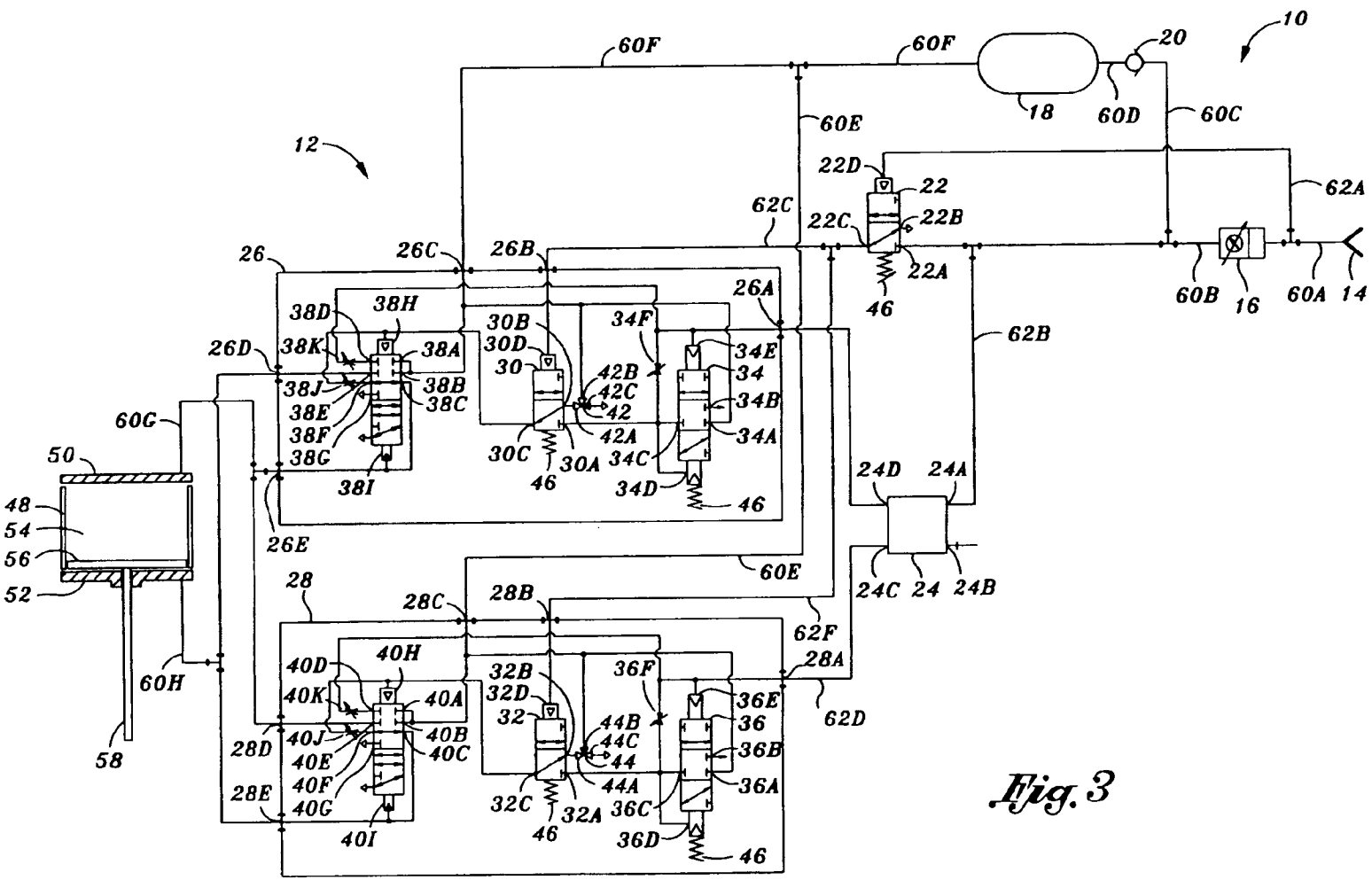
FIG. 3 is a schematic diagram of a second embodiment of the present invention illustrating the connective relationship of fluid passageways of the first and second derivative boosters with fluid passageways of the first and second volume boosters of the respective first and second pneumatic valving modules.

A second embodiment of the actuator system 10 is illustrated in FIG. 3 wherein the pneumatic circuit 12 is similar to the pneumatic circuit 12 of the first embodiment shown in FIG. 2. However, in FIG. 3, the routing of the second adjustable restrictions 38K, 40K is altered from that of the first embodiment. In FIG. 3, the second adjustable restriction 38K of the first derivative booster 38 is fluidly connected to the first volume booster 34. Likewise, the second adjustable restriction 40K of the second derivative booster 40 is fluidly connected to the second volume booster 40. By connecting the second adjustable restrictions 38K, 40K in this manner, the path of the back flow is altered as compared to the path of the back flow in the first embodiment of FIG. 2.

In the second embodiment of FIG. 3, the back flow bypasses the respective first and second volume boosters 34, 36 and flows directly to the positioner 24 where it is exhausted while in the first embodiment, the back flow passes through the volume boosters 34, 36 prior to exhausting out of the positioner 24. By eliminating the first and second volume boosters 34, 36 from the flow path, the respective derivative boosters 38, 40 may be de-energized more rapidly, thereby minimizing or eliminating overshooting of the piston 56. It is contemplated that the first and second adjustable restrictions 38J, 38K, 40J, 40K of the respective first and second derivative boosters 38, 40 and the first adjustable restriction 34F, 36F of the respective first and second volume boosters 34, 36 may be configured as needle valves.

Figure 4:
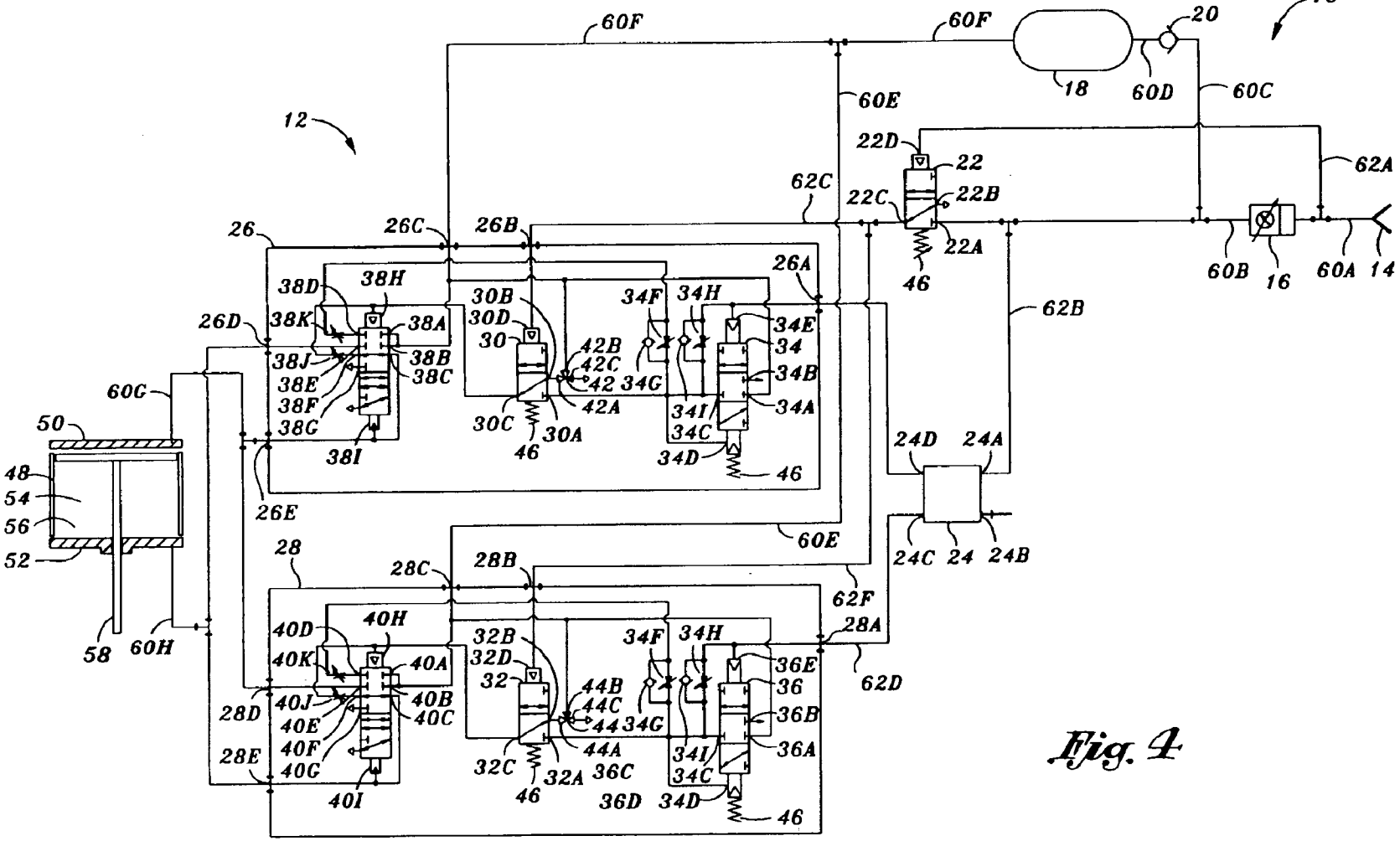
FIG. 4 is a schematic diagram of a third embodiment of the present invention illustrating the connective relationship of fluid passageways of the first and second derivative boosters with a first check valve and a first adjustable restriction of the first and second volume boosters.

A third embodiment of the actuator system 10 is illustrated in FIG. 4 wherein the pneumatic circuit 12 is similar to the pneumatic circuit 12 of the second embodiment shown in FIG. 3. In FIG. 4, the first and second volume boosters 34, 36 of the pneumatic circuit 12 may include a first check valve 34G, 36G. The respective first check valves 34G, 36G are fluidly connected in parallel to the respective first adjustable restriction 34F, 36F of the respective first and second volume boosters 34, 36. The first check valve 34G of the first volume booster 34 is oriented to block the flow of compressed air away from the pilot 34D. Likewise, the first check valve 36G of the second volume booster 36 is oriented to block the flow of compressed air away from the pilot 36D.

In the third embodiment of FIG. 4, the first and second volume boosters 34, 36 may further include respective second adjustable restrictions 34H, 36H and respective second check valves 34I, 36I fluidly connected in parallel to the first adjustable restrictions 34F, 36F. The second adjustable restrictions 34H, 36H and second check valves 34I, 36I are configured to collectively regulate the point at which the first and second volume boosters 34, 36 are energized. The second check valve 34I of the first volume booster 34 is oriented to block the flow of compressed air away from the pilot 34E. The second check valve 36I of the second volume booster 36 is oriented to block the flow of compressed air away from the pilot 36E.

The combination of the first adjustable restriction 34F with the first check valve 34G provides the capability to separately regulate the point at which the first volume booster 34 toggles into the supply mode. Similarly, the combination of the second adjustable restriction 34H with the second check valve 34I provides the capability to regulate the point at which the first volume booster 34 toggles into the exhaust mode. By providing two sets of check valves 34G, 34I and adjustable restrictions 34F, 34H, the point at which the first volume booster 34 may be triggered into the supply and exhaust modes may be separately regulated. The connective arrangement and operation of the first and second check valves 36G, 36I with respective ones of the first and second adjustable restrictions 36F, 36H for the second volume booster 36 is identical to that of the first volume booster 34. It is contemplated that the first and second adjustable restrictions 34F, 34H, 36F, 36H, of the first and second volume boosters 34, 36 may be configured as needle valves.

When the pressure of compressed air acting on the volume boosters 34, 36 reaches a predetermined level, the volume boosters 34, 36 toggle from a "closed" or null position to a supply or exhaust position. In this manner, the inclusion of first and second adjustable restrictions 34F, 34H, 36F, 36H with first and second check valves 34G, 34I, 36G, 36I for respective ones of the first and second volume boosters 34, 36 allows for the adjustment of the sensitivity of the volume boosters 34, 36 in the exhaust mode without affecting the sensitivity thereof in the supply mode. This means that the first and second volume boosters 34, 36 may be activated into the supply position by very small pneumatic signals, but may only be activated into the exhaust position by large pneumatic signals. When the first and second volume boosters 34, 36 are activated into the supply or exhaust modes, a greater flow of compressed air from the feed lines may pass through the volume boosters 34, 36 and flow towards the respective derivative boosters 38, 40. Activation of the derivative boosters 38, 40 is then dependent on the magnitude of the combined pneumatic signal of the positioner 24 plus the pneumatic signal of the respective volume boosters 36, 40.

The operation of the first embodiment of the actuator system 10 will now be discussed. The compressed air source 14 provides pressurized air into the pneumatic circuit 12. The safety valve 22 receives the compressed air at the pilot 22D, toggling the safety valve 22 from the normally closed position into the energized position such that the actuator system 10 is toggled into the control mode. Simultaneously, the filter regulator 16 receives the compressed air from the air source 14 and reduces the pressurization level of the air source 14 to a safe working pressure. However, as was mentioned earlier, there are a number of pressurization settings for the filter regulator 16 that may be workable depending on capacities of downstream components in the pneumatic circuit 12. From the filter regulator 16, the compressed air flows to the volume tank check valve 20, if included, and into the volume tank 18.

Once the safety valve 22 is energized, the first and second commutators 30, 32 receive the flow of compressed air from the filter regulator 16 after the compressed air enters the respective first and second pneumatic valving modules 26, 28 at the respective commutator ports 26B, 28B. Overcoming the resistive force of the springs 46, the first and second commutators 30, 32 toggle into the energized position, thereby allowing flow between the first and second volume boosters 34, 36 and the respective first and second derivative boosters 38, 40.

The positioner 24 simultaneously receives the compressed air from the filter regulator 16. The positioner 24 also receives the piston 56 position signal indicating the position of the piston 56 within the cylinder 54. The positioner 24 converts the piston 56 position signal to a pneumatic signal for controlling the position of the piston 56 within the cylinder 54. As was mentioned above, the piston 56 position signal may be supplied to the positioner 24 through a pneumatic control line or it may be electronically transmitted to the positioner 24. The positioner 24 selectively provides pneumatic signals indicative of the desired piston 56 movement to correct for disparity between the actual position of the piston 56 and the, desired position of the piston 56. The pneumatic signals are provided in the form of compressed air to the first and second pneumatic valving modules 26, 28 which then collectively manipulate the flow compressed air.

In an exemplary operational sequence, the retraction of the piston 56 from the second end 52 toward the first end 50 will be described wherein the positioner 24 supplies compressed air to the second pneumatic valving module 28 in order to feed the second end 52 while the positioner 24 simultaneously allows compressed air to exit the first pneumatic valving module 26 in order to exhaust the first end 50. The description of the operation sequence of the second pneumatic valving module 26 during the piston 56 retraction follows. For relatively small pneumatic signals, the difference between the actual position of the piston 56 and the desired position of the piston 56 is proportionally small. With such small pneumatic signals, the compressed air flows from the positioner 24 out of control port 24C, passes through the volume booster port 28A into the second pneumatic valving module 28 in order to pass through the second volume booster 36, through the second commutator 32, through the second derivative booster 40 before passing through its second derivative booster port 28E in order to exit the second pneumatic valving module 28 and enter the second end 52. Simultaneously, the compressed air flows from the first end 50, enters the first pneumatic valving module 26 at the first derivative booster 38 port in order to pass through the first derivative booster 38, through the first commutator 30, through the first volume booster 34, passing through the volume booster port 26A in order to exit the first pneumatic valving module 26 before exhausting into the positioner 24 at control port 24D.

For larger pneumatic signals, the compressed air flows from the positioner 24 into and out of the first and second pneumatic valving modules 26, 28 through the respective ones of the volume booster ports 26A, 28A and respective ones of the first derivative booster ports 26D, 28D. However, the manipulation of the compressed air within the first and second pneumatic valving modules 26, 28 is different. Depending on the setting of the first adjustable restrictions 34F, 36F, of the respective first and second volume boosters 34, 36, the exhaust coming from the first end 50 may be amplified by the first volume booster 34. The flow of compressed air from the first end 50 enters the first pneumatic valving module 26 through the second derivative booster port 26E, passing through ways 38B–38E of the first derivative booster 38. The flow passes through the first adjustable restriction 38J of the first derivative booster 38 and passes through ways 30C–30A of the first commutator 30. If the flow rate is low enough, then depending on the setting of the first adjustable restriction 34F of the first volume booster 34, the flow can then pass through the first adjustable restriction 38J of the first derivative booster 38 without energizing the first derivative booster 38 into the exhaust mode.

However, if the flow rate is high enough to energize the first derivative booster 38 into the exhaust mode, then the first end 50 of the cylinder 54 is quickly exhausted through ways 30C–30G of the first derivative booster 38 at a Cv of 9.0. By way of comparison, the flow rate of the positioner 24 is typically on the order of less than 1.0. Thus, it can be seen that the first derivative booster has the capability to rapidly exhaust the compressed air. Simultaneous with the energization of the first derivative booster 38, the second end 52 of the cylinder 54, which is fluidly connected to the volume tank 18 by the air supply port 26C of the first derivative booster 38 through ways 40F–40C, is supplied with compressed air at a Cv of 4.5. The compressed air from the volume tank 18 passes through the first derivative booster 38 and out of the first pneumatic valving module 26 at the first derivative booster port 26D, flowing into the second end 52. The additional flow of compressed air into the second end 52 coupled with the rapid exhaustion out of the first end 50 allows for a very quick stroking speed of the piston 56.

During the energization of the first derivative booster 38, ways 38B–38E are opened, allowing a back flow to pass through ways 38A–38D of the first derivative booster 38, regulated by the second adjustable restriction 38K thereof. The back flow passes through the first commutator 30, passing through the first volume booster 34 and out of the positioner 24. At high flow rates of the positioner 24 (i.e. when there is a large gap between the actual piston 56 position signal and the desired piston 56 position signal), the back flow is not sufficient to increase the pressure differential between the positioner 24 and the first derivative booster 38 to de-energize the first derivative booster 38.

However, when the flow rate of the positioner 24 decreases (i.e. there is a small gap between the actual piston 56 position signal and the desired piston 56 position signal), the back flow is sufficient to increase the pressure differential between the positioner 24 and the first derivative booster 38 to de-energize the first derivative booster 38. Thus, the first derivative booster 38 is toggled back to its de-energized position, shutting off both the rapid exhaust of the first end 50 and the rapid supply of the second end 52 through the first derivative booster 38. The back flow is simultaneously shut off. When the first derivative booster 38 is de-energized, the positioner 24 provides a much slower exhaustion of the first end 50 and a much slower supply of the second end 52. In this manner, the positioner 24 moves the piston 56 slowly over the final distance as it nears the desired piston 56 position, thereby minimizing the risk of overshooting the desired piston 56 position. By adjusting the second adjustable restriction 38K of the first derivative booster 38, the point at which the first derivative booster 38 may be de-energized can be controlled. This delay characteristic, wherein the first derivative booster 38 is toggled to the de-energized position, provides a high degree of dynamic stability in that the piston 56 is prevented from overshooting the desired piston 56 position as the piston 56 closes in on the desired piston 56 position near the end of its travel.

Simultaneous with the operation of the first pneumatic valving module 26, the positioner 24 supplies compressed air out of control port 24C into the second pneumatic valving module 28 at the volume booster port 28A. At high flow rates, the second volume booster 36 is energized depending on the setting of the first adjustable restriction 36F. Compressed air flows from the volume tank 18, entering the second pneumatic valving module 28 at the air supply port 28C. The compressed air passes into the second volume booster 36 through ways. 36A–36C, passing through the second commutator 32 through ways 32A–32B, flowing through the first adjustable restriction 38J of the first derivative booster 38, passing through ways 40F–40C and exiting the second pneumatic valving module 28 at the second derivative booster port 28D before entering the second end 52.

The operation of the first and second pneumatic valving modules 26, 28 during piston 56 extension, wherein the piston 56 moves from the fist end toward the second end 52, is identical to that described above, only in reverse.

The operation of the second embodiment of FIG. 3 is similar to that of the first embodiment of FIG. 2 as was described above, except that the path of the back flow is altered, as can be seen in FIG. 3. Continuing on with the discussion of the first embodiment wherein the operation of the first pneumatic valving module 26 is described for the case where the first end 50 is being exhausted, the back flow passes through the first adjustable restriction 38J of the first derivative booster 38, bypassing the first commutator 30 and the first derivative booster 38 totally so that it exhausts out of the positioner 24. Contrary to the first embodiment wherein the back flow passes through the volume boosters 34, 36 prior to exhausting out of the positioner 24, in the second embodiment, the back flow bypasses the first volume booster 34 and flows directly to the positioner 24. By eliminating the first volume booster 34 from the flow path in the second embodiment, the first derivative booster 38 is de-energized more rapidly, thereby minimizing or eliminating overshooting of the piston 56.

The operation of the third embodiment of FIG. 4 is also similar to that of the first and second embodiments except for additional adjustability of the point of energization of the first volume booster 34 provided by the inclusion of the first and second adjustable restrictions 34F, 34H, and first and second check valves 34G, 34I, of the third embodiment. The second check valve 34I of the first volume booster 34 is oriented to block the flow of compressed air away from the pilot 34E. The second check valve 34G of the first volume booster 34 is oriented to block the flow of compressed air away from the pilot 34D.

The combination of the first adjustable restriction 34F with the first check valve 34G provides the capability to regulate the point at which the first volume booster 34 toggles into the supply mode. Similarly, the combination of the second adjustable restriction 36F with the second check valve 36G provides the capability to regulate the point at which the second volume booster 34 toggles into the exhaust mode. By providing two sets of check valves 34G, 34I and adjustable restrictions 34F, 34H, the point at which the first volume booster 34 is triggered into the supply and exhaust modes may be separately regulated. The operation of the first and second check valves 36G, 36I with respective ones of the first and second adjustable restrictions 36F, 36H for the second volume booster 36 is identical to that just described for the first volume booster 34.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. An actuator system for positioning a piston within a cylinder of a pneumatic circuit, the cylinder having first and second ends, the system comprising:

a compressed air source for providing a flow of compressed air to the pneumatic circuit;

a positioner fluidly connected to the compressed air source and configured for regulating the flow of compressed air into and out of the first and second ends;

first and second pneumatic valving modules fluidly connected to the positioner and to each one of the first and second ends, the first and second pneumatic valving modules comprising:

first and second volume boosters fluidly connected to the positioner and configured to amplify the flow of compressed air through respective ones of the first and second pneumatic valving modules;

first and second derivative boosters fluidly connected to each one of the first and second ends and configured to alternately supply and exhaust compressed air into and out of the first and second ends;

first and second commutators fluidly connected between respective ones of the first and second derivative boosters and respective ones of the first and second volume boosters and configured to selectively allow the compressed air to flow therebetween;

a safe valve fluidly connected to the compressed air source and to each one of the first and second commutators, the safety valve being configured to open upon attainment of a predetermined pressurization level of the compressed air such that the first and second commutators may be energized; and a volume tank fluidly connecting the compressed air source to the first an second derivative boosters and configured to provide compressed air directly to each one of the first and second derivative boosters upon energization of the first and second commutators.

2. The actuator system of claim 1 further comprising:

first and second internal plugs fluidly connected to respective ones of the first and second commutators;

the first and second internal plugs being selectively operative to exhaust compressed air out of the cylinder through alternate ones of the first and second commutators such that the piston may be alternately extended and retracted upon a loss of pressurization of the pneumatic circuit.

3. The actuator system of claim 1 further comprising:

a volume tank check valve fluidly connected to and interposed between the volume tank and the compressed air source;

the volume tank check valve being oriented such that the flow of compressed air from the volume tank towards the compressed air source may be blocked.

4. The actuator system of claim 1 wherein:

the first and second derivative boosters each include a first adjustable restriction fluidly connected to respective ones of the first and second commutators; and each one of the first adjustable restrictions is configured to regulate the point at which respective ones of the first and second derivative boosters are energized such that compressed air from the volume tank may flow into the cylinder.

5. The actuator system of claim 4 wherein:

the first and second derivative boosters each include a second adjustable restriction fluidly connected to respective ones of the first and second commutators; and each one of the second adjustable restrictions is configured to regulate the point at which respective ones of the first and second volume boosters are de-energized.

6. The actuator system of claim 5 wherein the second adjustable restrictions of respective ones of the first and second derivative booster are fluidly connected to respective ones of the first and second volume boosters.

7. The actuator system of claim 5 wherein the first and second adjustable restrictions are needle valves.

8. The actuator system of claim 6 wherein:

the first and second volume boosters each include a first adjustable restriction fluidly connected to respective ones of the first and second derivative boosters; and each one of the first adjustable restrictions is configured to regulate the point at which the first and second volume boosters are toggled between supplying and exhausting compressed air into and out of the cylinder.

9. The actuator system of claim 8 wherein each of the first and second volume boosters includes a first check valve fluidly connected in parallel to the first adjustable restriction.

10. The actuator system of claim 9 wherein:

each of the first and second volume boosters includes a second adjustable restriction and a second check valve fluidly connected in parallel to the first adjustable restriction and interposed between each one of the first and second volume boosters and respective ones of the first and second derivative boosters; and the second adjustable restriction and second check valves are configured to collectively regulate the point at which the first and second volume boosters are energized.

11. The actuator system of claim 10 wherein the first and second adjustable restrictions are needle valves.

12. A pneumatic valving module for manipulating a flow of compressed air within a pneumatic circuit, the pneumatic circuit having a positioner and a cylinder with first and second ends, the positioner being configured to regulate the flow of compressed air into and out of the first and second ends, the pneumatic valving module comprising:

a volume booster fluidly connected to the positioner and configured to amplify the flow of compressed air from the positioner;

a derivative booster fluidly connected to the first and second ends and configured to alternately supply and exhaust compressed air into and out of the first and second ends;

a commutator fluidly connected between the derivative booster and the volume booster and configured to selectively allow the compressed air to flow there between; and a volume tank fluidly connected directly to the derivative booster and configured to provide compressed air directly thereto upon energization of the commutator.

13. The pneumatic valving module of claim 12 further comprising:

an internal plug fluidly connected to the commutator;

the internal plug being selectively operative to alternately block and unblock the flow of compressed air out of the cylinder such that the piston may be alternately extended and retracted upon a loss of pressurization of the pneumatic circuit.

14. The pneumatic valving module of claim 12 wherein:

the derivative booster includes a first adjustable restriction fluidly connected to the commutator; and the first adjustable restriction is configured to regulate the point at which the derivative booster is energized such that compressed air from the volume tank may flow into the cylinder.

15. The pneumatic valving module of Clam 14 wherein:

the derivative booster includes a second adjustable restriction fluidly connected to the commutator; and the second adjustable restriction is configured to regulate the point at which the volume booster is de-energized.

16. The pneumatic valving module of claim 15 wherein the first and second adjustable restrictions are needle valves.

17. The pneumatic valving module of claim 16 wherein:

the volume booster includes a first adjustable restriction fluidly connected to the derivative booster; and the first adjustable restriction is configured to regulate the point at which the volume booster is toggled between supplying and exhausting compressed air into and out of the cylinder.

18. The pneumatic valving module of claim 17 wherein the volume booster includes a first check valve fluidly connected in parallel to the first adjustable restriction.

19. The pneumatic valving module of claim 18 wherein:

the volume booster includes a second adjustable restriction and a second check valve fluidly connected in parallel to the first adjustable restriction and interposed between the volume booster and the derivative booster; and the second adjustable restriction and second check valves are configured to collectively regulate the point at which the volume booster is energized.

20. The pneumatic valving module of claim 19 the first and second adjustable restrictions of the volume booster are needle valves.

* * * * *